US006262528B1

(12) United States Patent
Kim

(10) Patent No.: US 6,262,528 B1
(45) Date of Patent: Jul. 17, 2001

(54) FIELD EMISSION DISPLAY (FED) AND METHOD FOR ASSEMBLING SPACER OF THE SAME

(75) Inventor: Jong-min Kim, Yongin (KR)

(73) Assignee: Samsung Display Devices Co., Ltd. (KR)

( * ) Notice: Subject to any disclaimer, the term of this patent is extended or adjusted under 35 U.S.C. 154(b) by 0 days.

(21) Appl. No.: 09/197,647

(22) Filed: Nov. 23, 1998

(30) Foreign Application Priority Data

Nov. 28, 1997 (KR) ..... 97-63971
Dec. 5, 1997 (KR) ..... 97-66330
Feb. 3, 1998 (KR) ..... 98-2948

(51) Int. Cl.[7] ..... H01J 1/62
(52) U.S. Cl. ..... 313/495; 445/24
(58) Field of Search ..... 313/495, 482, 313/485, 493, 494, 620, 238, 281, 292; 445/24, 50

(56) References Cited

U.S. PATENT DOCUMENTS 5,708,325 * 1/1998 Anderson et al. ..... 313/495
5,720,640 * 2/1998 Lu et al. ..... 445/24
5,859,508 * 1/1999 Ge et al. ..... 313/422
5,864,205 * 1/1999 Dworsky ..... 313/495
6,008,573 * 12/1999 Beeteson et al. ..... 313/422

* cited by examiner

*Primary Examiner*—Ashok Patel
*Assistant Examiner*—Todd Reed Hopper
(74) *Attorney, Agent, or Firm*—Burns, Doane Swecker & Mathis

(57) ABSTRACT

A field emission display (FED) includes anode and cathode plates facing each other, having facing surfaces on which anodes and cathodes of a predetermined pattern are respectively formed, a multitude of micro tips formed on the cathode, at a predetermined spacing, an insulating layer formed on the cathode plate, surrounding and exposing the micro tips, a gate formed on the insulating layer, and spacers interposed between the anode plate and the cathode plate to maintain a predetermined spacing between the anode plate and the cathode plate, each having one end fixed in a hole formed on the anode plate.

20 Claims, 9 Drawing Sheets

FIELD EMISSION DISPLAY (FED) AND METHOD FOR ASSEMBLING SPACER OF THE SAME

BACKGROUND OF THE INVENTION

1. Field of the Invention

The present invention relates to a field emission display (FED), and more particularly, to a method for assembling a spacer for maintaining a constant interval between an anode plate and a cathode plate, and to an FED employing the same.

2. Description of the Related Art

Referring to a conventional field emission display (FED) of FIG. 1, an anode plate 11 and a cathode plate 12 face to each other, maintained at a constant spacing by a spacer 13. A plurality of micro tips 14 are formed on a cathode 12*a* of the cathode plate 12. The micro tips 14 are surrounded and exposed by an insulating layer 15. Gates 17 are formed on the insulating layer 15. A fluorescent film 18 is formed under an anode 11*a* of the anode plate 11.

In manufacturing the FED, the spacer 13 is formed by screen-printing and curing a glass paste several times, using a mask 19.

By the screen-printing method, it is known that the screen-printing and the curing must be repeated approximately 7 times to form the spacer 13 giving a spacing of approximately 200 $\mu$m between the anode plate 11 and the cathode plate 12. The process repetitions are proportional to the spacing between the anode plate 11 and the cathode plate 12. The screen-printing method requires repetition of screen-printing and curing and thus manufacturing spacers requires much time. Also, in the screen-printing, the glass paste may flow down, and it is difficult to increase an aspect ratio, i.e., the ratio of the height of the spacer 13 to the width thereof, to 1 or more, due to an alignment error of the screen.

Further, some of the electrons emitted from the micro tips 14 collide with the spacer 13 made of glass, and are dispersed.

SUMMARY OF THE INVENTION

It is an objective of the present invention to provide a method for assembling a spacer of a field emission display (FED) in which the spacer can be simply assembled between an anode plate and a cathode plate, and an aspect ratio of the spacer is 1 or more, and an FED manufactured using the same.

It is another objective of the present invention to provide a spacer in which the spacer supplies a repulsive force against electron beams to suppress dispersion of the electron beams and increase luminosity.

Accordingly, to achieve the above objective, a method for assembling a spacer of a FED including the steps of (a) forming a plurality of holes in an anode plate or a cathode plate, (b) coating an adhesive on a first end of each of a plurality of spacers of a predetermined length for maintaining the spacing between the anode plate and the cathode plate by a predetermined value, and/or in the holes, (c) inserting the first ends of the spacer respectively into the holes, and (d) curing the adhesive.

The step (a) may include the substeps of coating a photosensitive layer of a predetermined thickness on the anode plate or cathode plate, etching the photosensitive layer in a region where the holes are to be formed, to thereby form openings, forming holes in the anode or cathode plate exposed by the openings, using sand blasting, and removing the photosensitive layer.

Otherwise, the step (a) may include the steps of coating a photosensitive layer of a predetermined thickness on the anode plate or cathode plate, etching the photosensitive layer in a region where the holes are to be formed, to thereby form openings, etching the anode or cathode plate exposed by the openings to form the holes, and removing the photosensitive layer.

According to another aspect of the present invention, there is provided a method for assembling a spacer of a FED including the steps of (a) forming a multitude of openings where connection holes are to be formed there between, in an anode of an anode plate, (b) forming holes in the openings, smaller than the openings, in the anode plate, (c) forming a grid line in the connection holes on the anode plate for electrically connecting the holes, separated from the anode, (d) providing spacers each consisting of a glass fiber and a conductive layer coated on part of the outer surface of the glass fiber, extending from one end of the glass fiber, (e) coating metal paste for adhesion on the end of each spacer having the conductive layer, and in the holes, (f) inserting the ends of the spacers having the conductive layer respectively into the holes, and (g) curing the metal paste.

The FED according to another aspect of the present invention includes anode and cathode plates facing each other, having facing surfaces on which anodes and cathodes of a predetermined pattern are respectively formed, a multitude of micro tips formed on the cathode, at a predetermined spacing, an insulating layer formed on the cathode plate, surrounding and exposing the micro tips, a gate formed on the insulating layer, and spacers interposed between the anode plate and the cathode plate to maintain a predetermined spacing between the anode plate and the cathode plate, each having one end fixed in a hole formed on the anode plate.

The spacer comprises a glass fiber having one end fixed in the hole formed on the anode plate, and a conductive layer coated on the surface of the glass fiber to a predetermined length, to partially expose the surface of the glass fiber.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
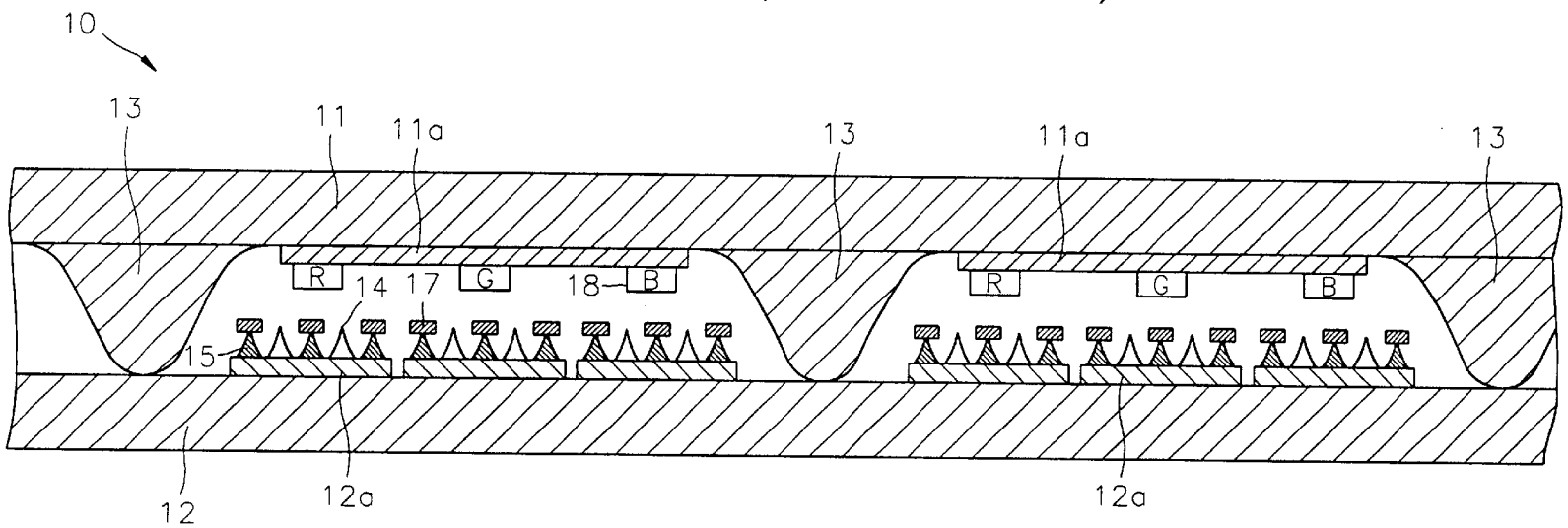
FIG. 1 (PRIOR ART)
FIG. 1 is a sectional view of a conventional field emission display (FED)
Figure 2:
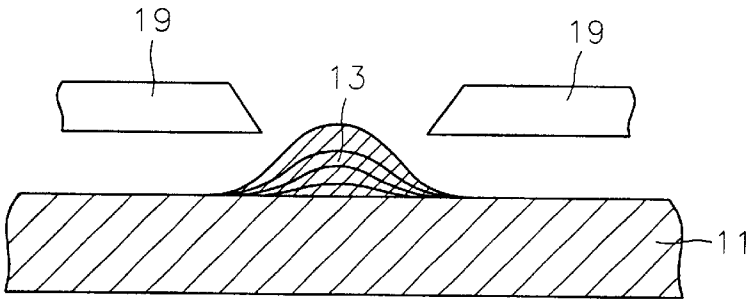
FIG. 2 (PRIOR ART)
FIG. 2 is a sectional view illustrating a method for manufacturing a spacer of the FED of FIG. 1.
Figure 3:
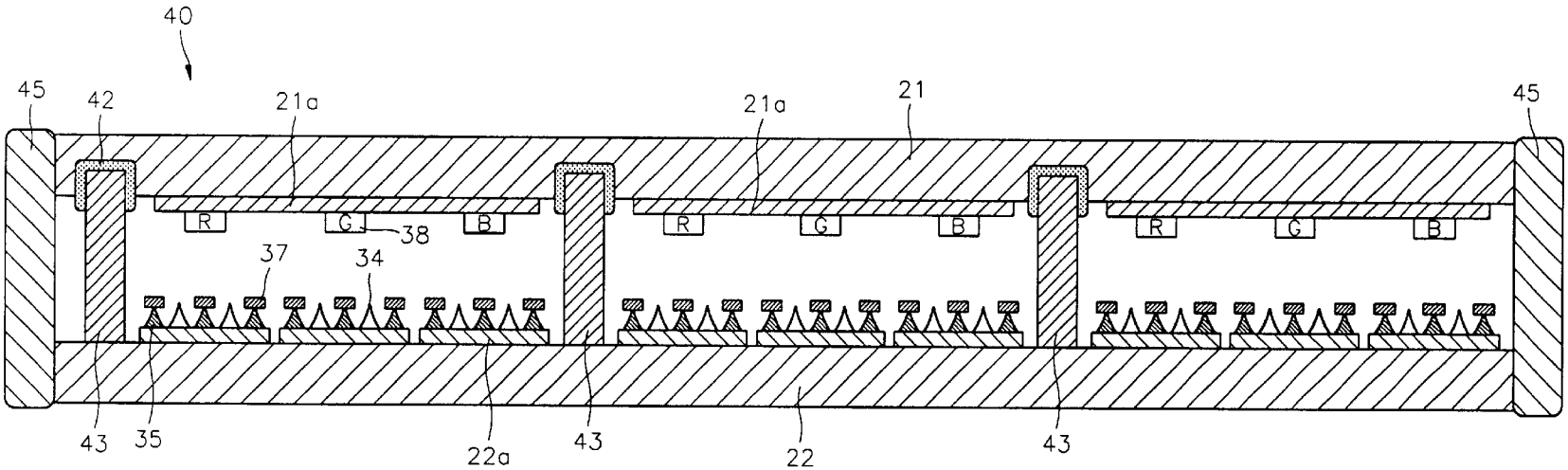
FIG. 3 is a sectional view showing a FED according to the first embodiment of the present invention.

Referring to FIG. 3 showing a field emission display (FED) 40 according to a first embodiment of the present invention, an anode plate 21 and a cathode plate 22 face to each other, maintained at a predetermined spacing by a spacer 43, and an anode 21*a* and a cathode 22*a* of a predetermined pattern are formed on the anode plate 21 and the cathode plate 22, respectively. A space between the anode plate 21 and the cathode plate 22 is sealed by a sealant 45. A fluorescent film 38 is coated on the anode 21*a* of the anode plate 21. A plurality of micro tips 34 are formed on the cathode 22*a* of the cathode plate 22, and the micro tips 34 are surrounded with an insulating layer 35, with their upper portions exposed. Gates 37 are formed on the insulating layer 35.

The spacer 43 is a glass bar, and is connected to the anode plate 21 by a glass paste 42 which is an adhesive.

A method for assembling the spacer 43 of the FED 40 will be described with reference to FIGS. 4A through 4G.

Figure 4A:
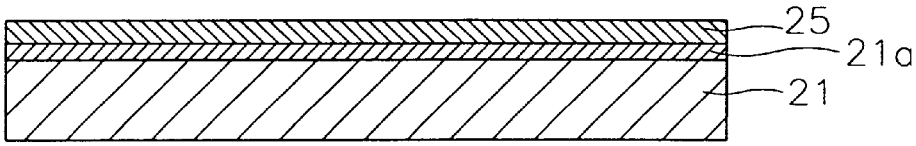
FIGS. 4A through 4G are sectional views illustrating a method for assembling a spacer of the FED of FIG. 3.
Figure 4B:
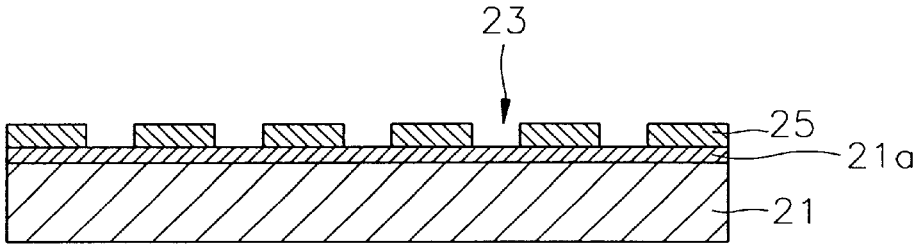

A plurality of holes for connecting a plurality of spacers 43 are formed on the anode plate 21 or the cathode plate 22 of FIG. 3. That is, as shown in FIG. 4A, a photosensitive layer 25 of a predetermined thickness, for example photoresist, is formed on the anode plate 21. Then, as shown in FIG. 4B, the photosensitive layer 25 is exposed to light and etched to form openings 23 having a size corresponding to the holes to be formed.

Figure 4C:
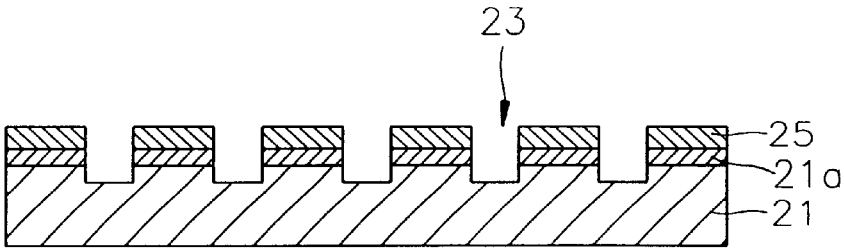

Then, the part of the anode plate 21 exposed through the openings 23 is abraded to a predetermined depth by sand blasting, as shown in FIG. 4C. Alternatively, the part of the anode plate 21 exposed through the openings 23 may be etched.

Figure 4D:
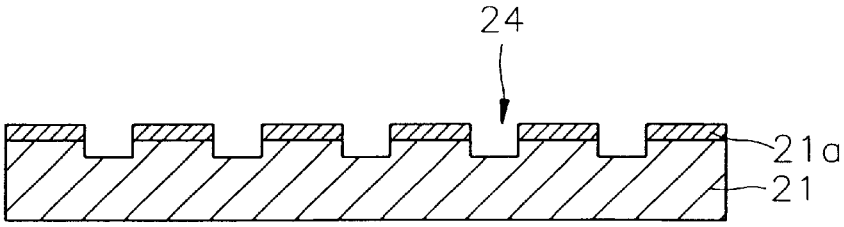
Figure 4E:
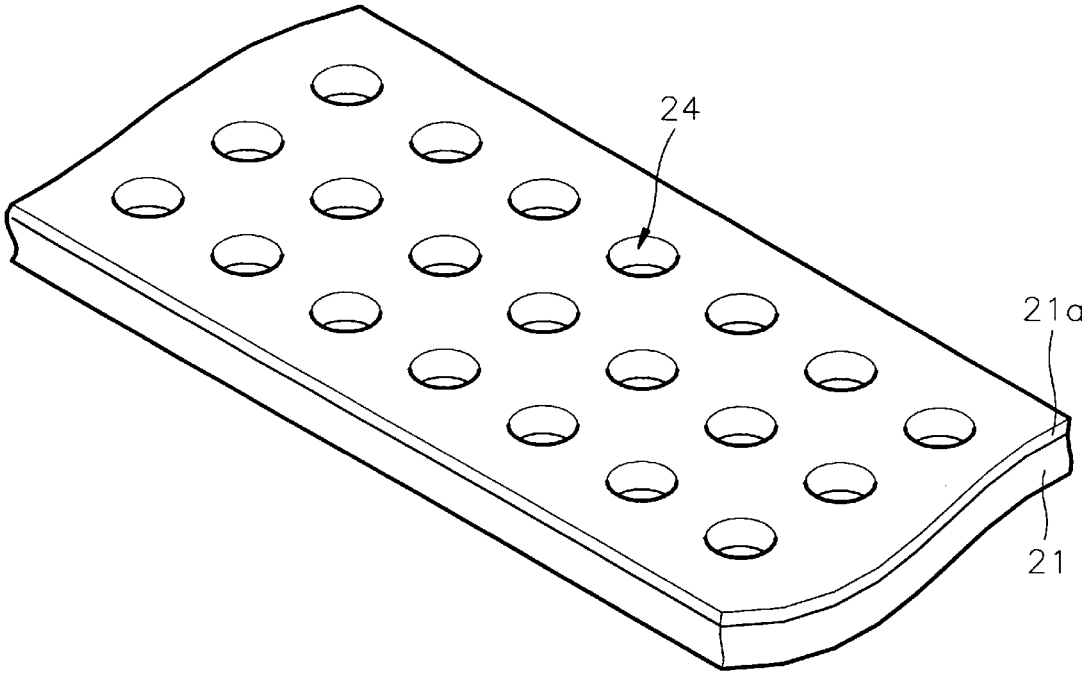

Subsequently, when the photosensitive layer 25 is removed, holes 24 for connecting a spacer are completely formed as shown in FIGS. 4D and 4E.

Figure 4F:
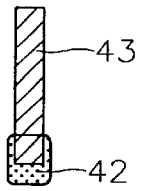

As shown in FIG. 4F, an adhesive glass paste 42 is coated on one end of a glass bar used for the spacer 43, to a predetermined thickness. Alternatively, the glass paste 42 may be appropriately poured into the hole 24 of the anode plate 21. Preferably, both processes may be performed. It is also preferable that the glass paste 42 is injected into the hole 24 by screen-printing. Here, the glass paste 42 indicates a frit glass liquid.

The length of the spacer 43 is decided according to the spacing between the anode plate 21 and the cathode plate 22. Preferably, the spacing is approximately 200 $\mu$m and the bar section is circular.

Figure 4G:
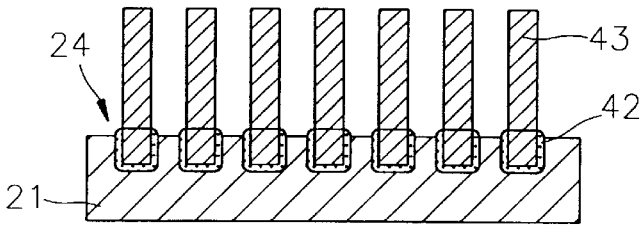

Subsequently, as shown in FIG. 4G, one end of each spacer 43 is inserted into a hole 24 of the anode plate 21, to be connected thereto. At this time, the spacers 43 are aligned parallel with each other.

The spacers 43 inserted into the holes 24 of the anode plate 21 are annealed at a predetermined temperature, so that they are joined by curing the glass paste 42.

Then, the cathode plate 22, having the micro tips 34 of FIG. 3, is located on the other ends of the spacers 43, and sealed with the anode plate 21, by a sealant 45 of frit glass to have a vacuum of $10^{-7}$ torr.

Figure 5:
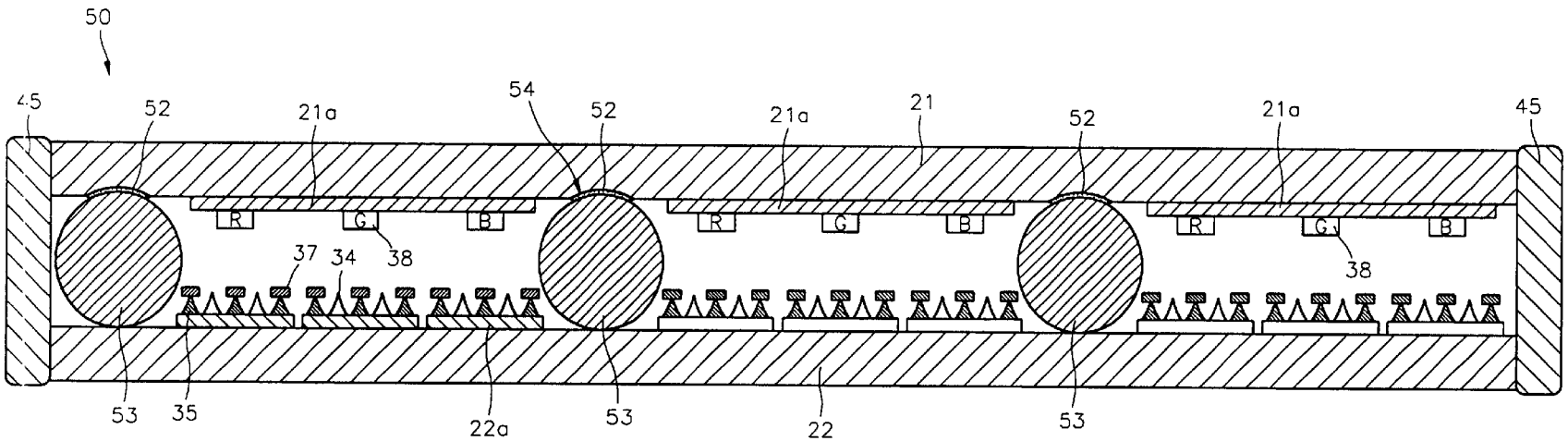
FIG. 5 is a sectional view of a FED according to a second embodiment of the present invention.

A FED 50 manufactured by a method according to a second embodiment of the present invention is shown in FIG. 5. Here, like reference numerals refer to like elements.

According to characteristics of the present embodiment, a spacer 53 between the anode plate 21 and the cathode plate 22 is spherical. A spherical hole 54 corresponding to the shape of the spacer 53 is formed, for example, in the anode plate 21, for connection with the spacer 53. That is, the spherical spacer 53 is settled in the spherical hole 54 and connected by glass paste 52.

The process of assembling the spacer 53 is the same as that of the first embodiment.

Like the first embodiment, preferably, the spacer 53 is formed of glass, and the spacing maintained by the spacer 53 between the anode plate 21 and the cathode plate 22 is approximately 200 $\mu$m.

Figure 6:
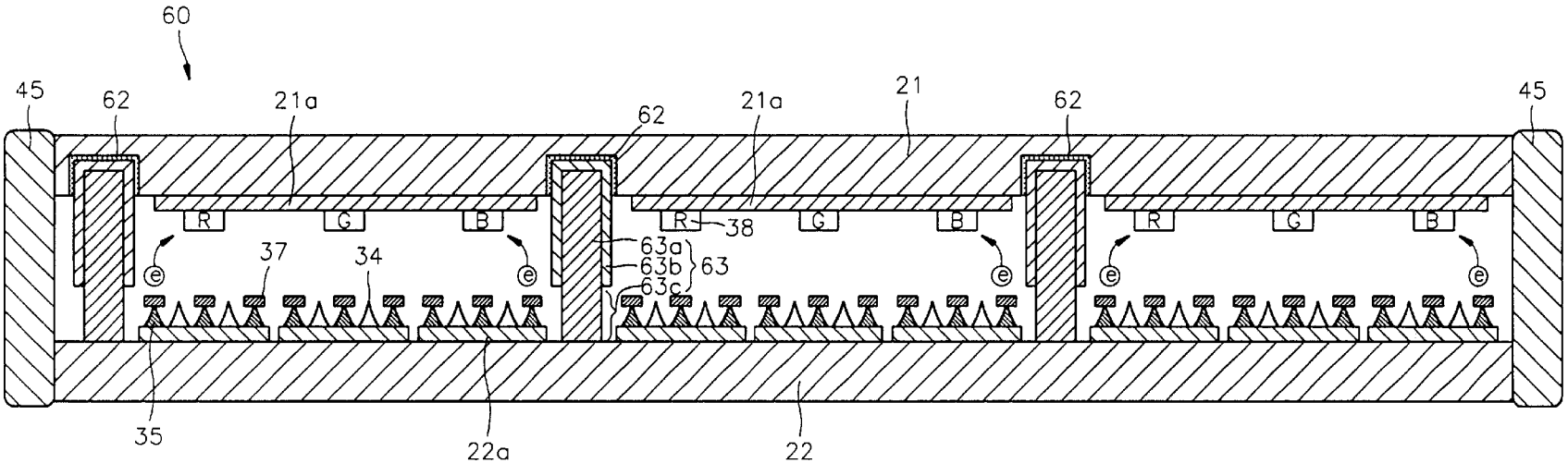
FIG. 6 is a sectional view of a FED according to a third embodiment of the present invention.

A FED 60 according to a third embodiment of the present invention is shown in FIG. 6. Like reference numerals refer to like elements.

Referring to FIG. 6, a spacer 63 connected to the anode plate 21 includes a cylindrical glass fiber 63*a*, a conductive layer 63*b* coated on part of the outer surface of the glass fiber 63*a*, and an exposed portion 63*c* uncoated with the conductive layer 63*b*. The conductive layer 63*b* is formed of a conductive material such as Cr or Ti.

Figure 7A:
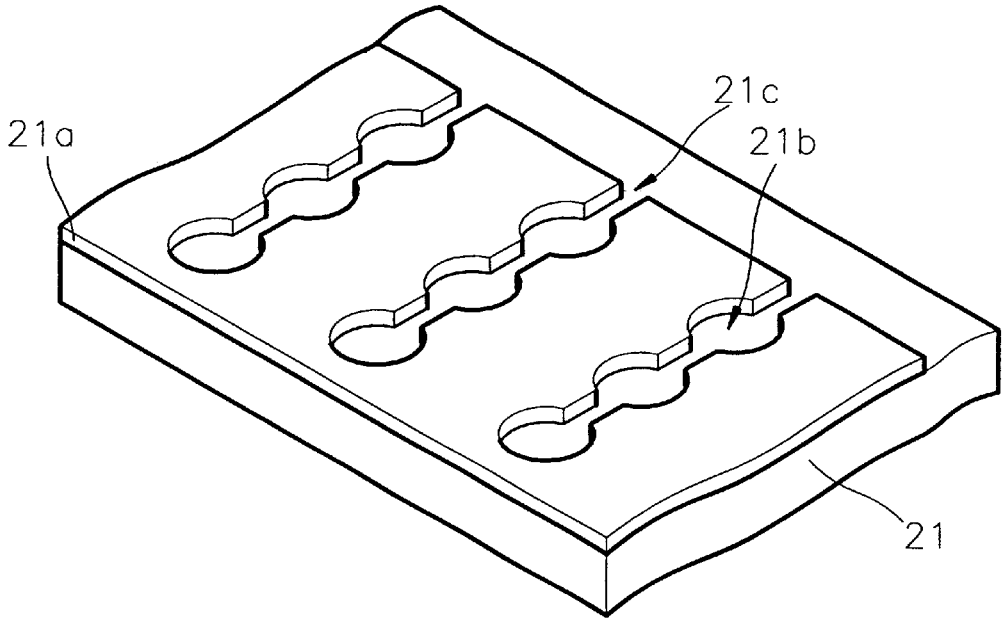
FIGS. 7A through 7E are sectional views illustrating a method for assembling a spacer of the FED of FIG. 6.
Figure 7B:
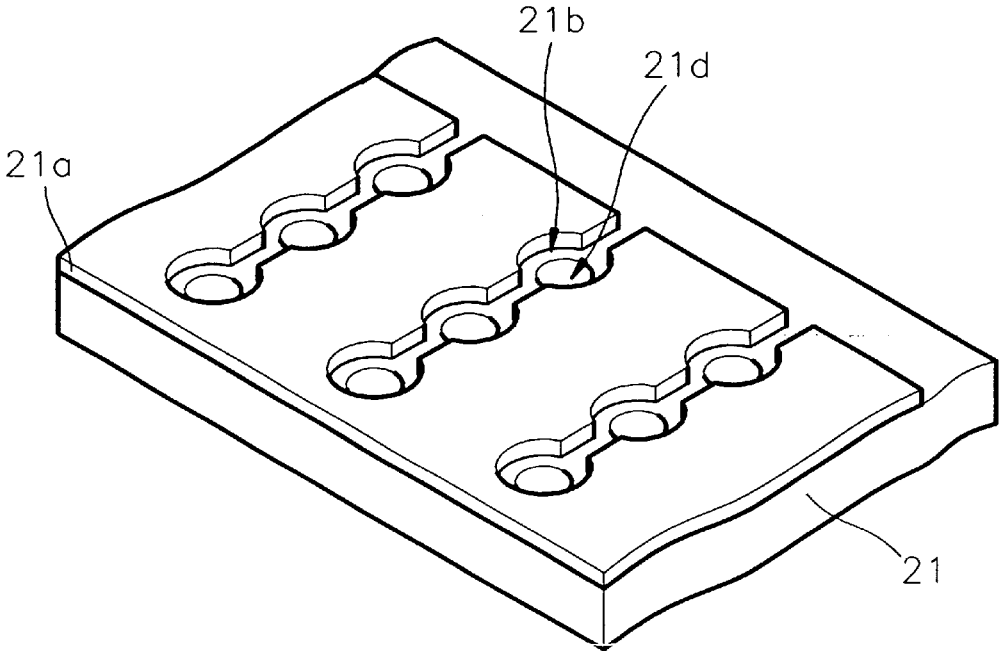
Figure 7C:
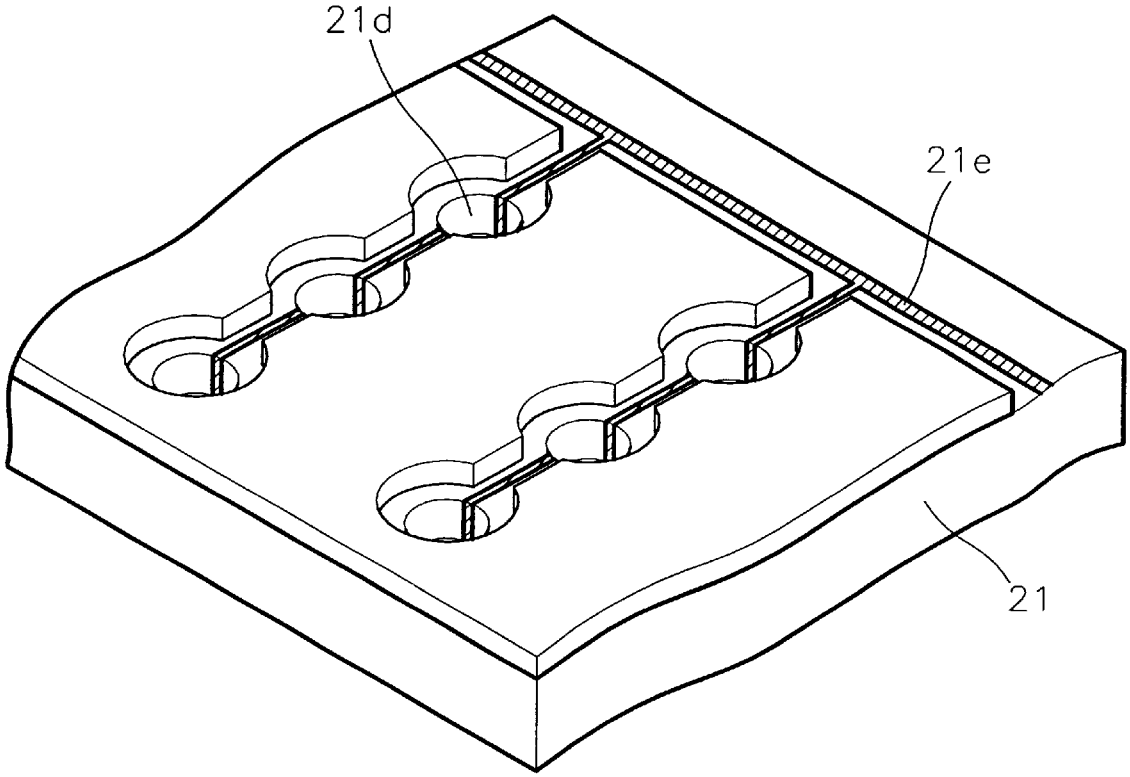

The conductive layers 63*b* of adjacent spacers 63 are electrically connected to each other by a grid line (see 21*e* of FIG. 7C).

A method for assembling a spacer of the FED 60 will be described with reference to FIGS. 7A through 7E.

As shown in FIG. 7A, an anode 21*a* formed of an ITO layer is coated on the anode plate 21 where the spacer 63 is to be fixed. Subsequently, circular openings 21*b* and connection grooves 21*c* connecting the openings 21*b* are formed in the anode 21*a* by typical photolithography. Here, preferably, the anode plate 21 is an insulating material formed of glass.

As shown in FIG. 7B, holes 21*d* of a predetermined depth for connecting spacers are formed in the anode plate 21 in the openings 21*b*. Here, the diameter of each 21*d* is smaller than that of each opening 21*b*. As described above, the holes 21*d* are formed by the sand blast, using the photosensitive layer, or by etching.

Subsequently, as shown in FIG. 7C, a grid line 21*e* electrically connecting the holes 21*d* is formed between the holes 21*d*. That is, the grid line 21*e* extends to the upper surface of the anode plate 21 between the holes 21*d* and preferably to the inner walls of the holes 21*d*. Also, the grid line 21*e* is separated from the anode 21*a*, and connected to an external circuit (not shown). The grid line 21*e* is formed of Al and Cr using a lift-off method by typical photolithography.

Figure 7D:
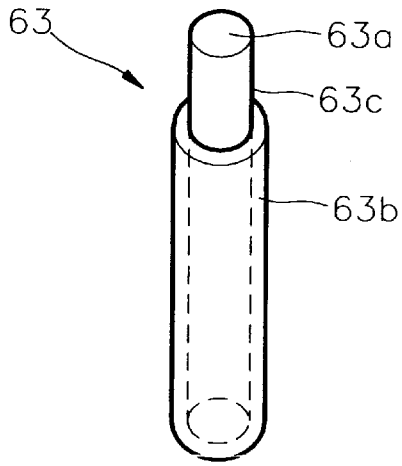

As shown in FIG. 7D, a conductive layer 63*b* is coated on at least part of the surface of the glass fiber 63*a*. That is, the conductive layer 63*b* is coated from one end of the glass fiber 63*a* to a predetermined length, and other surfaces of the glass fiber 63*a* are an exposed portion 63*c* which are not coated with the conductive layer 63*b*. The conductive layer 63*b* is formed by depositing a conductive material such as Cr or Ti.

It is also preferable that the length of the spacer 63 maintains the spacing between the anode plate 2 and cathode plate 22 at 200 $\mu$m.

Figure 7E:
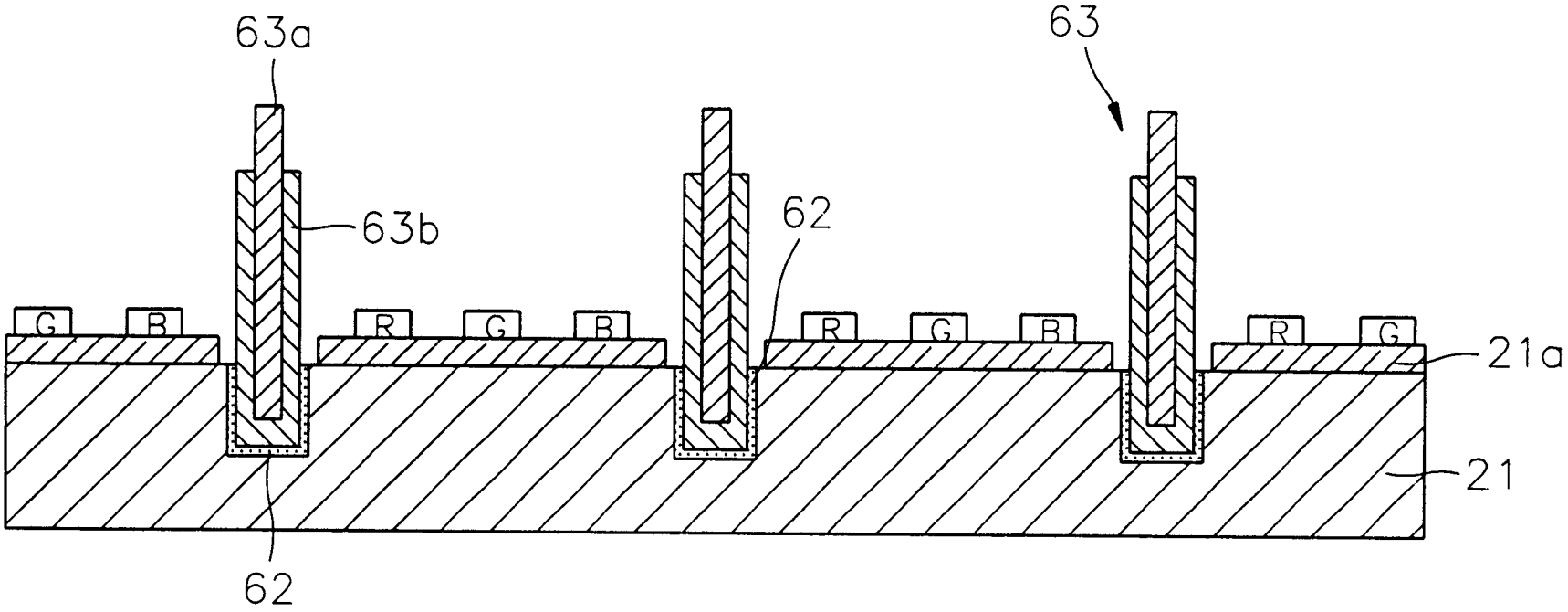

Subsequently, as shown in FIG. 7E, a metal paste 62 for adhesion is coated in the holes 21*d* to connect the spacers 63 to the holes 21*d* of the anode plate 21. At this time, the metal paste may be coated on one end of each spacer 63 to be connected to a hole 21*d*. Preferably, the metal paste is silver paste. The metal paste ensures electrical connection of the conductive layer 63*b* to the grid line 21*e*, when the spacers 63 are connected to the holes 21*d*.

As shown in FIG. 7E, an end of the spacer 63 where the conductive layer 63*b* is formed is inserted into the hole 21*d* of the anode plate 21, and the metal paste 62 on the inserted end is cured by annealing, to thereby fix the spacer 63. At this time, the conductive layer 63*b* is electrically connected to the grid line 21*e* of FIG. 7C formed on the inner wall of the hole 21*d*, by the metal paste 62.

Subsequently, the cathode plate 22 of FIG. 6 where the micro tips 34 are formed is located on the other end of the exposed portions 63C of the spacers 63 fixed to the anode plate 21, and the cathode plate 22 is sealed with a sealant 45 of FIG. 6 formed of frit glass.

In operation of the above-described FED, if a negative (−) bias is applied to the conductive layer 63*b* through the grid line 21*e*, the conductive layer 63*b* becomes a grid electrode.

In this state, if a predetermined positive bias is applied to the gate 37, electrons are emitted from the micro tips 34. At this time, the spacer 63 exerts an electric repulsive force on the emitted electrons. Thus, the electrons proceed to the fluorescent film 38 without loss caused by colliding with the spacer 63, increasing the luminosity of the FED.

According to the present invention, additional spacers are bonded by a sealant to holes in an anode plate, simplifying and speeding manufacture. The spacer is formed of glass, allowing a higher aspect ratio. Also, the spacer can be used as part of the grid electrode, so that more emitted electrons reach a fluorescent film, thereby increasing the luminosity.

What is claimed is:

1. A method for assembling a spacer of a field emission display (FED) comprising the steps of:

(a) forming a plurality of holes in an anode plate or a cathode plate;

(b) coating an adhesive on a first end of each of a plurality of spacers of a predetermined length for maintaining the spacing between the anode plate and the cathode plate by a predetermined value, and/or in the holes;

(c) inserting the first ends of the spacer respectively into the holes; and (d) curing the adhesive to fix the spacers in the holes.

2. The method of claim 1, wherein the spacer is formed of glass.

3. The method of claim 2, wherein the spacer is bar shaped.

4. The method of claim 2, wherein the spacer is spherical.

5. The method of claim 2, wherein the length of the spacer is such that the spacing between the anode plate and the cathode plate is approximately 200 $\mu$m.

6. The method of claim 1, wherein the step (a) comprises the substeps of:

coating a photosensitive layer of a predetermined thickness on the anode plate or cathode plate;

etching the photosensitive layer in a region where the holes are to be formed, to thereby form openings;

forming holes in the anode or cathode plate exposed by the openings, using sand blast; and removing the photosensitive layer.

7. The method of claim 1, wherein the step (a) comprises the steps of:

coating a photosensitive layer of a predetermined thickness on the anode plate or cathode plate;

etching the photosensitive layer in a region where the holes are to be formed, to thereby form openings;

etching the anode or cathode plate exposed by the openings to form the holes; and removing the photosensitive layer.

8. The method of claim 1, wherein the adhesive is glass paste.

9. The method of claim 1, wherein the adhesive is coated in the holes by the screen-printing.

10. A method for assembling a spacer of a field emission display (FED) comprising the steps of:

(a) forming a multitude of openings where connection holes are to be formed there between, in an anode of an anode plate;

(b) forming holes in the openings, smaller than the openings, in the anode plate;

(c) forming a grid line in the connection holes on the anode plate for electrically connecting the holes, separated from the anode;

(d) providing spacers each consisting of a glass fiber and a conductive layer coated on part of the outer surface of the glass fiber, extending from one end of the glass fiber;

(e) coating metal paste for adhesion on the end of each spacer having the conductive layer, and in the holes;

(f) inserting the ends of the spacers having the conductive layer respectively into the holes; and (g) curing the metal paste.

11. The method of claim 10, wherein the metal paste for adhesion contains silver.

12. The method of claim 10, wherein the length of the spacer is such that the spacing between the anode plate and the cathode plate is approximately 200 $\mu$m.

13. The method of claim 10, wherein the spacer is cylindrical.

14. The method of claim 10, wherein the grid line is formed of Al or Cr.

15. The method of claim 13, wherein the conductive layer is formed of Cr or Ti.

16. A field emission display (FED) comprising:

anode and cathode plates facing each other, having facing surfaces on which anodes and cathodes of a predetermined pattern are respectively formed;

a multitude of micro tips formed on the cathode, at a predetermined spacing;

an insulating layer formed on the cathode plate, surrounding and exposing the micro tips;

a gate formed on the insulating layer; and spacers interposed between the anode plate and the cathode plate to maintain a predetermined spacing between the anode plate and the cathode plate, each having one end fixed in a hole formed on the anode plate.

17. The FED of claim 16, wherein the spacer is a glass bar.

18. The FED of claim 16, wherein the spacer comprises:

a glass fiber having one end fixed in the hole formed on the anode plate; and a conductive layer coated on the surface of the glass fiber to a predetermined length, to partially expose the surface of the glass fiber.

19. The FED of claim 18, further comprising a grid line formed on the anode plate and electrically connecting the conductive layers of the spacers, to apply a negative voltage.

20. The FED of claim 16, wherein each spacer is a glass sphere.

* * * * *